US007739749B2

(12) United States Patent
Grilliot et al.

(10) Patent No.: US 7,739,749 B2
(45) **Date of Patent: *Jun. 22, 2010**

(54) REVERSIBLE, PROTECTIVE GARMENT FOR MILITARY OR PARAMILITARY FIREFIGHTER OR EMERGENCY WORKER

(75) Inventors: William L. Grilliot, Dayton, OH (US); Mary I. Grilliot, Dayton, OH (US); Patricia K. Lewis, Tipp City, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 1492 days.

This patent is subject to a terminal disclaimer.

(21) Appl. No.: 11/079,829

(22) Filed: Mar. 14, 2005

(65) Prior Publication Data

US 2006/0000003 A1 Jan. 5, 2006

Related U.S. Application Data

(63) Continuation-in-part of application No. 10/782,273, filed on Feb. 19, 2004, now Pat. No. 7,146,646, which is a continuation of application No. 10/350,862, filed on Jan. 24, 2003, now abandoned.

(51) Int. Cl.
*A41D 13/00* (2006.01)

(52) U.S. Cl. ..... 2/81; 2/97

(58) Field of Classification Search ..... 2/81, 2/93, 94, 96, 97, 69, 85, 115, 915, 77, 102, 2/DIG. 2

See application file for complete search history.

(56) References Cited

U.S. PATENT DOCUMENTS 238,945 A 3/1881 Marks
1,052,475 A 2/1913 Friedman
1,224,704 A 5/1917 Berger
1,648,250 A 11/1927 Wolslawsky
1,914,236 A 6/1933 Berkwits
1,971,682 A 8/1934 Hoch
2,138,041 A 11/1938 Preston
2,174,831 A 10/1939 Muller
2,711,539 A 6/1955 Loscher
3,018,486 A 1/1962 Bulkspan
3,837,007 A 9/1974 Girest
4,103,361 A 8/1978 Carmen
4,338,686 A 7/1982 Bell
4,365,354 A 12/1982 Sullivan
4,472,835 A 9/1984 Clark (Continued)

*Primary Examiner*—Tejash Patel
(74) *Attorney, Agent, or Firm*—Wood, Phillips, Katz, Clark & Mortimer

(57) ABSTRACT

A protective garment for a military or paramilitary firefighter or emergency worker has a shell of high visibility with trim that is reflective, fluorescent, or both, a shell of low visibility without such trim, and a moisture barrier between the shells. Being reversible, the protective garment is wearable with either shell facing outwardly and with the other shell facing inwardly. In terms of heat resistance, flame resistance, and tear strength, each shell conform to all applicable standards of NFPA 1971 for outer shells of protective clothing. In terms of thermal protection performance, the protective garment conforms to all applicable standards of NFPA 1971 for all layers of protective clothing. Desirably, the protective garment conforms to the standards of NFPA 1971, no matter which shell faces outwardly when the protective garment is worn, except that the shell of low visibility does not have trim that is reflective, fluorescent, or both.

6 Claims, 1 Drawing Sheet

U.S. PATENT DOCUMENTS

| | | | |
|---|---|---|---|
| 4,774,725 | A | 10/1988 | Page |
| 5,029,344 | A | 7/1991 | Shannan et al. |
| 5,040,243 | A | 8/1991 | Tatsuno |
| 5,043,202 | A | 8/1991 | Knickerbocker |
| 5,054,125 | A | 10/1991 | Snedeker |
| 5,189,737 | A | 3/1993 | Ribicic |
| 5,561,860 | A | 10/1996 | Nguyen-Senderowicz |
| 5,675,838 | A | 10/1997 | Hollinger |
| 5,799,329 | A | 9/1998 | Hauschild |
| 5,884,332 | A | 3/1999 | Snedeker |
| 5,933,865 | A | 8/1999 | Aldridge |
| 6,009,560 | A | 1/2000 | McKenney et al. |
| 6,128,783 | A | 10/2000 | Blauer et al. |
| 6,272,688 | B1 | 8/2001 | Wilson |
| 6,345,393 | B1 | 2/2002 | Bayer |
| 6,421,834 | B2 | 7/2002 | Kester |
| 6,523,180 | B1 | 2/2003 | Christopher |
| 6,550,066 | B1 | 4/2003 | Brassey |
| 6,728,970 | B1 | 5/2004 | Grilliot et al. |
| 6,892,394 | B2 | 5/2005 | Grilliot et al. |
| 7,168,097 | B2 * | 1/2007 | Grilliot et al. ..... 2/81 |
| 2002/0016985 | A1 | 2/2002 | Kelleher et al. |
| 2002/0083507 | A1 | 7/2002 | Mullis |
| 2004/0143882 | A1 | 7/2004 | Gardner et al. |

* cited by examiner

REVERSIBLE, PROTECTIVE GARMENT FOR MILITARY OR PARAMILITARY FIREFIGHTER OR EMERGENCY WORKER

CROSS-REFERENCE TO RELATED APPLICATIONS

This application is a continuation-in-part of U.S. patent application Ser. No. 10/782,273, which was filed on Feb. 19, 2004, and the disclosure of which is incorporated herein by reference. U.S. patent application Ser. No. 10/782,273 is a continuation of U.S. patent application Ser. No. 10/350,862, which was filed on Jan. 24, 2003, which was published as United States Patent Application Publication No. US2004/0143883 A1 on Jul. 29, 2004, and which has been abandoned.

TECHNICAL FIELD OF THE INVENTION

This invention pertains to a protective garment for a firefighter or emergency worker, particularly a military or paramilitary firefighter or emergency worker. This invention contemplates that the protective garment is reversible so as to expose, as an outer shell, either a shell of high visibility or a shell of low visibility.

BACKGROUND OF THE INVENTION

Protective garments for firefighters and emergency workers include coats, trousers, overalls, and coveralls. Current National Fire Protection Association (NFPA) standards include the National Fire Protection Association (NFPA) 1971 standard for "Protective Clothing for Structural Fire Fighting", hereinafter NFPA 1971. NFPA 1971 requires protective clothing to have an outer shell meeting certain standards for heat resistance, flame, resistance, and tear strength. NFPA 1971 requires all layers of protective clothing to meet certain standards for thermal protection performance. NFPA 1971 requires the outer shell of said clothing to have reflective trim, which enhances the visibility of the protective garment and, therefore, the visibility of its wearer under smoke-laden and other adverse conditions. Generally, reflective trim is affixed by sewing, adhesively, or otherwise.

However, for a military or paramilitary firefighter or emergency worker operating where a tactical operation has developed or is expected to develop, a need for low visibility may override a need for high visibility. Heretofore, a military or paramilitary firefighter or emergency worker may have to be issued two types of protective garments, i.e., protective garments to be worn in a tactical operation, in which the need for low visibility overrides the need for high visibility, and protective garments to be worn otherwise.

The discussion of NFPA 1971 in the Background of the Invention in U.S. Pat. No. 5,933,865 is incorporated herein by reference.

SUMMARY OF THE INVENTION

This invention provides a protective garment for a military or paramilitary firefighter or emergency worker. The protective garment has a shell of high visibility with portions that are reflective, fluorescent, or both, which portions may be provided by trim that is reflective, fluorescent, or both, a shell of low visibility without such portions, and a moisture barrier between the shells. Being reversible, the protective garment is wearable with either shell facing outwardly and with the other shell facing inwardly.

As contemplated by this invention, in terms of heat resistance, flame resistance, and tear strength, each shell conforms to all applicable standards of NFPA 1971 for heat resistance, flame resistance, and tear strength of outer shells of protective clothing. Preferably, in terms of thermal protection performance, the shells and the moisture barrier between the shells conform to all applicable standards of NFPA 1971 for thermal protection performance all layers of protective clothing. Desirably, in terms of all properties covered by NFPA 1971, the protective garment conforms to NFPA 1971, no matter which shell faces outwardly when the protective garment is worn, except that the shell of low visibility does not have portions like those of the shell of high visibility that are reflective, fluorescent, or both.

DETAILED DESCRIPTION OF THE ILLUSTRATED EMBODIMENT

Figure 1:
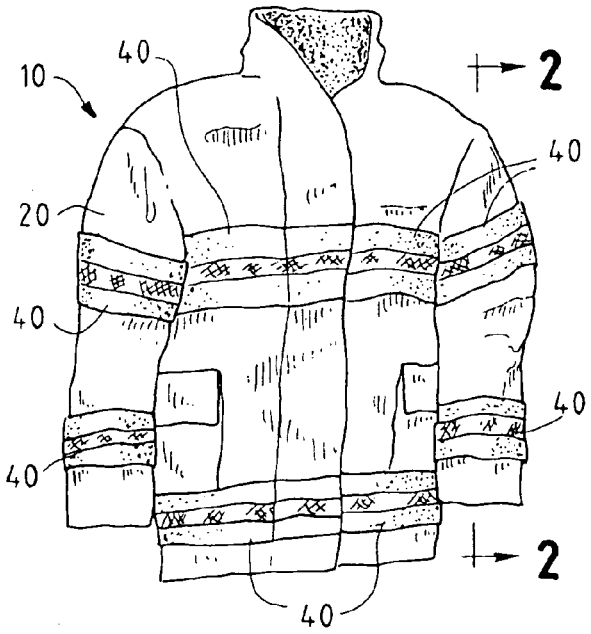
FIG. 1 is a front elevation of a protective coat embodying this invention, as worn with its shell of high visibility facing outwardly.
Figure 2:
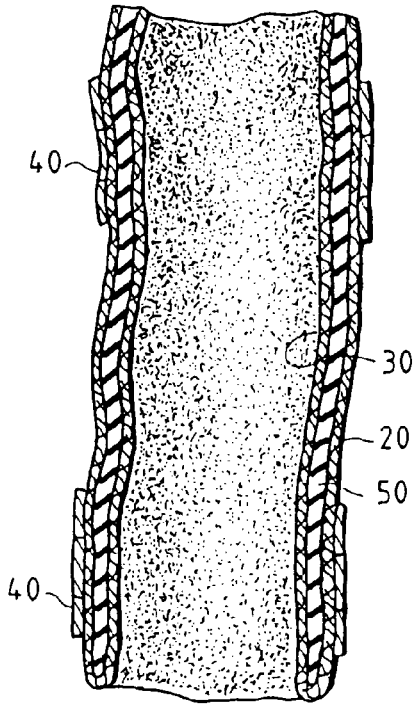
FIGS. 2 and 4 are cross-sections, as taken respectively along line 2-2 of FIG. 1 and along line 4-4 of FIG. 2 in directions indicated by arrows.
Figure 3:
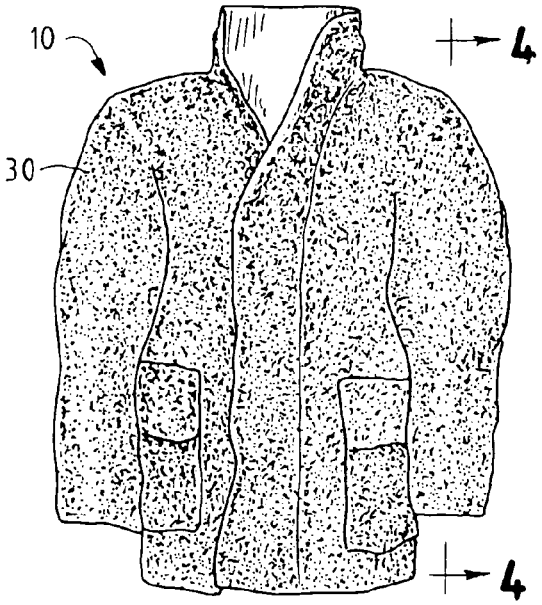
FIG. 3 is a front elevation of the same coat, as worn with its shell of low visibility facing outwardly.
Figure 4:
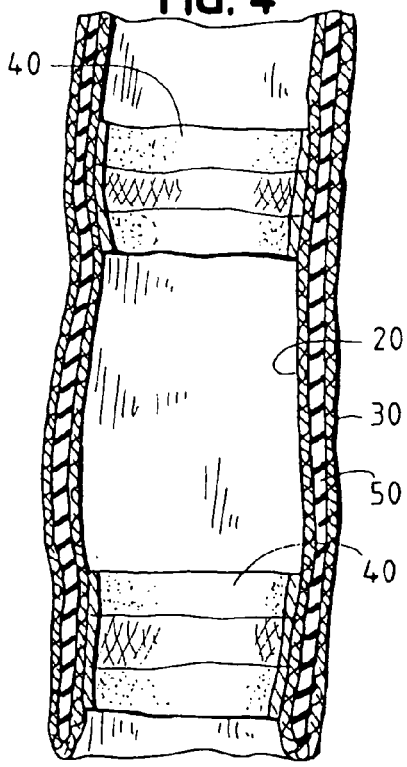

As illustrated, a protective coat 10 for a military or paramilitary firefighter or emergency worker embodies this invention and has a shell 20 of high visibility and a shell 30 of low visibility. As contemplated by this invention, the shell 20 of high visibility has several strips 40 of reflective trim, which the shell 30 of low visibility does not have. Preferably, when facing outwardly, the shell 30 of low visibility appears black, or at least dark, in ambient light. Alternatively, when facing outwardly, the shell 30 of low visibility displays camouflage.

As illustrated, the protective coat 10 has between the shells 20, 30, a layer 50 providing a moisture barrier. Along with the layer 50 providing the moisture barrier, another layer or other layers may be also provided between the shells 20, 30, such as a layer providing thermal insulation.

Preferably, except that the shell 30 of low visibility does not have reflective trim, each of the shells 20, 30, conform in terms of heat resistance, flame resistance, and tear strength to all applicable standards of NFPA 1971 for heat resistance, flame resistance, and tear strength of outer shells of protective clothing covered by NFPA 1971. Preferably, in terms of thermal protection performance, the protective coat 10 conforms to all applicable standards of NFPA 1971 for thermal protection performance of protective clothing covered by NFPA 1971. Preferably, in terms of all properties covered by NFPA 1971, the protective coat 10 conforms to NFPA 1971, no matter which shell 20, 30, faces outwardly when the protective coat 10 is worn, except that the shell 30 of low visibility does not have reflective trim.

Preferably, moreover, the shells 20, 30, are equal, or at least similar, in basis weights. A preferred material for the shells 20, 30, is Nomex™ material having a basis weight of nine ounces (9 oz.) per square yard, as available commercially from E. I. du Pont de Nemours and Company of Wilmington, Del. Such material is available commercially in patterns that display camouflage. Scotchlite™ reflective trim is suitable, as available commercially from Minnesota Mining and Manufacturing Company of St. Paul, Minn.

In a tactical operation, in which the need for low visibility overrides the need for high visibility, a military or paramilitary firefighter or emergency worker may wear the protective coat 10 with the shell 30 of low visibility facing outwardly. Otherwise, the firefighter or emergency worker may wear the protective coat 10 with the shell 20 of high visibility facing outwardly. If a tactical operation develops or is expected to develop while a military or paramilitary firefighter or emergency worker is wearing the protective garment 10 with the shell 20 of high visibility facing outwardly, the firefighter or emergency worker may have an opportunity to doff the protective coat 10, reverse it, and re-don it with the shell 30 of low visibility facing outwardly.

Although a protective coat is illustrated, this invention may be also embodied in other protective garments, such as trousers, overalls, and coveralls.

The invention claimed is:

1. For a military or paramilitary firefighter or emergency worker, a protective garment, which is reversible, which has a first shell of high visibility with portions that are reflective, fluorescent, or both, which has a second shell of low visibility without such portions, which has a moisture barrier between the first and second shells, and which is wearable with either the first or second shell facing outwardly and with the other of the first and second shells facing inwardly, wherein NFPA 1971 refers to the National Fire Protection Association (NFPA) 1971 standard for "Protective Clothing for Structural Fire Fighting" and wherein each shell conforms in terms of heat resistance, flame resistance, and tear strength to all applicable standards of NFPA 1971 for heat resistance, flame resistance, and tear strength of outer shells of protective clothing covered by NFPA 1971.

2. The protective garment of claim 1, wherein the first and second shells and the moisture barrier between the first and second shells conform in terms of thermal protection performance to all applicable standards of NFPA 1971 for thermal protection performance of all layers of protective clothing covered by NFPA 1971.

3. The protective garment of claim 2, which conforms to NFPA 1971, no matter which of the first and second shells faces outwardly when the protective garment is worn, except that the second shell does not have portions like those of the first shell that are reflective, fluorescent, or both.

4. For a military or paramilitary firefighter or emergency worker, a protective garment, which is reversible, which has a first shell of high visibility with trim that is reflective, fluorescent, or both, which has a second shell of low visibility without such trim, which has a moisture barrier between the first and second shells, and which is wearable with either the first or second shell facing outwardly and with the other of the first and second shells facing inwardly, wherein NFPA 1971 refers to the National Fire Protection Association (NFPA) 1971 standard for "Protective Clothing for Structural Fire Fighting" and wherein each shell conforms in terms of heat resistance, flame resistance, and tear strength to all applicable standards of NFPA 1971 for heat resistance, flame resistance, and tear strength of outer shells of protective clothing covered by NFPA 1971.

5. The protective garment of claim 4, wherein the first and second shells and the moisture barrier between the first and second shells conform in terms of thermal protection performance to all applicable standards of NFPA 1971 for thermal protection performance of all layers of protective clothing covered by NFPA 1971.

6. The protective garment of claim 5, which conforms to NFPA 1971, no matter which of the first and second shells faces outwardly when the protective garment is worn, except that the second shell does not have trim that is reflective, fluorescent, or both.

* * * * *